US009044127B2

(12) United States Patent
Yato

(10) Patent No.: US 9,044,127 B2
(45) Date of Patent: Jun. 2, 2015

(54) CHARGING-TYPE ELECTRIC VACUUM CLEANER

(71) Applicant: Sharp Kabushiki Kaisha, Osaka-shi, Osaka (JP)

(72) Inventor: Yuki Yato, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/388,269

(22) PCT Filed: Mar. 11, 2013

(86) PCT No.: PCT/JP2013/056650

§ 371 (c)(1),
(2) Date: Sep. 26, 2014

(87) PCT Pub. No.: WO2013/179715

PCT Pub. Date: Dec. 5, 2013

(65) Prior Publication Data

US 2015/0059119 A1 Mar. 5, 2015

(30) Foreign Application Priority Data

May 31, 2012 (JP) ..... 2012-124709

(51) Int. Cl.
*A47L 9/28* (2006.01)
*A47L 9/19* (2006.01)

(52) U.S. Cl.
CPC ..... *A47L 9/19* (2013.01); *A47L 9/2884* (2013.01); *A47L 2201/00* (2013.01); *A47L 9/2831* (2013.01); *A47L 9/2842* (2013.01); *A47L 9/2868* (2013.01)

(58) Field of Classification Search
CPC ..... A47L 9/19; A47L 9/2831; A47L 9/2842; A47L 9/2868; A47L 9/2884; A47L 2201/00
USPC ..... 15/339
IPC ..... A47L 9/28
See application file for complete search history.

(56) References Cited

U.S. PATENT DOCUMENTS

| | | | | |
|---|---|---|---|---|
| 6,448,732 | B1 * | 9/2002 | Block | 318/635 |
| 2012/0112670 | A1 * | 5/2012 | Danestad et al. | 318/139 |
| 2012/0223581 | A1 * | 9/2012 | Conrad | 307/77 |
| 2014/0223688 | A1 * | 8/2014 | Reindle et al. | 15/339 |

FOREIGN PATENT DOCUMENTS

JP 2004-024491 A 1/2004

* cited by examiner

*Primary Examiner* — David Redding
(74) *Attorney, Agent, or Firm* — Keating & Bennett, LLP

(57) ABSTRACT

The subject of the invention is to easily detect whether the dust collection amount is full.
The present invention provide a charging-type electric vacuum cleaner comprising: a ventilator for suctioning air containing dust through a suction port; a motor for driving the ventilator; a dust collection section for filtering the suctioned air and capturing the dust; a storage battery; a switching element for connecting the storage battery to the motor; a current detecting section for detecting an electric current Ia flowing to the motor; a warning section for warning when a dust collection amount in a dust collection section is full; and a control section for operating the switching element to drive the motor, and for detecting a terminal voltage Vb of the storage battery and the electric current Ia to operate the warning section when $Vb \geq V_1$ and $Ia \leq I_1$ ($V_1$ and $I_1$ are preset values) are established.

4 Claims, 7 Drawing Sheets

CHARGING-TYPE ELECTRIC VACUUM CLEANER

TECHNICAL FIELD

The present invention relates to a charging-type electric vacuum cleaner, and more particularly to an autonomous or cordless charging-type electric vacuum cleaner.

BACKGROUND ART

As a background of the present invention, a charging-type electric vacuum cleaner has been known, the charging-type electric vacuum cleaner including an electric ventilator that applies a suction negative pressure to a dust collection chamber, a chargeable power source that supplies a drive current to the electric ventilator, current detecting means for detecting the drive current, and control means that controls the drive current, which is supplied to the electric ventilator, to be constant by controlling a duty ratio of the drive current based on the detected current detected by the current detecting means, wherein the control means reduces the value of the drive current supplied to the electric ventilator to a set value, and then, stops the electric ventilator, when the current value detected by the current detecting means becomes lower than a threshold value after the duty ratio reaches a predetermined value (e.g., see Patent Document 1).

PRIOR ART DOCUMENTS

Patent Documents

Patent Document 1: Japanese Patent Laid-open Publication No. 2004-24491

SUMMARY OF THE INVENTION

Problems to be Solved by the Invention

A conventional electric vacuum cleaner using a commercial AC power source detects a dust collection amount by using a characteristic in which a current in an electric ventilator is decreased when the dust collection amount is increased. However, the charging-type electric vacuum cleaner described in Patent Document 1 is controlled such that the current in the electric ventilator becomes constant with respect to the increase in the dust collection amount, so that this vacuum cleaner has a difficulty in detecting the dust collection amount from the change in the current in the electric ventilator.

The present invention is accomplished in view of the above circumstance, and aims to provide a charging-type electric vacuum cleaner that can easily detect a dust collection amount, and issue a warning when the dust collection amount is full.

Means of Solving the Problems

The present invention provides a charging-type electric vacuum cleaner including a ventilator that suctions air containing dust through a suction port; a motor that drives the ventilator; a dust collection section that filters the suctioned air and captures the dust; a storage battery; a switching element that connects the storage battery to the motor; a current detecting section that detects an electric current Ia flowing to the motor; a warning section that issues a warning when the dust collection amount in the dust collection section is full; and a control section that operates the switching element to drive the motor, detects a terminal voltage Vb of the storage battery and the electric current Ia, and operates the warning section when $Vb \geq V_1$ and $Ia \leq I_1$ ($V_1$ and $I_1$ are preset values) are established.

Effect of the Invention

According to the present invention, the situation in which the dust collection amount is full can be warned with a simple configuration without an error.

EMBODIMENT OF THE INVENTION

A charging-type electric vacuum cleaner according to the present invention includes a ventilator that suctions air containing dust through a suction port; a motor that drives the ventilator; a dust collection section that filters the suctioned air and captures the dust; a storage battery; a switching element that connects the storage battery to the motor; a current detecting section that detects an electric current Ia flowing to the motor; a warning section that issues a warning when the dust collection amount in the dust collection section is full; and a control section that operates the switching element to drive the motor, detects a terminal voltage Vb of the storage battery and the electric current Ia, and operates the warning section when $Vb \geq V_1$ and $Ia \leq I_1$ ($V_1$ and $I_1$ are preset values) are established.

The control section may continue to drive the motor even after the warning section is operated.

The charging-type electric vacuum cleaner may further include a manual input section that instructs a checking operation of a dust collection amount to the control section, wherein the control section may drive the motor only for a predetermined time in response to an output from the manual input section.

The control section may drive the motor only for a predetermined time after the charging of the storage battery is completed.

A battery whose terminal voltage is reduced with discharge, such as a lithium ion battery, a nickel-hydrogen battery, or a Ni—Cd battery, can be used for the storage battery.

A DC motor excited by permanent magnets can preferably be used for the motor.

The charging-type electric vacuum cleaner according to the present invention will be described below with reference to the drawings illustrating an embodiment of an autonomous vacuum cleaner. The present invention is not limited to the embodiment, and the present invention includes a cordless electric vacuum cleaner manually moved by a user.

1. Configuration of Autonomous Vacuum Cleaner

Figure 1:
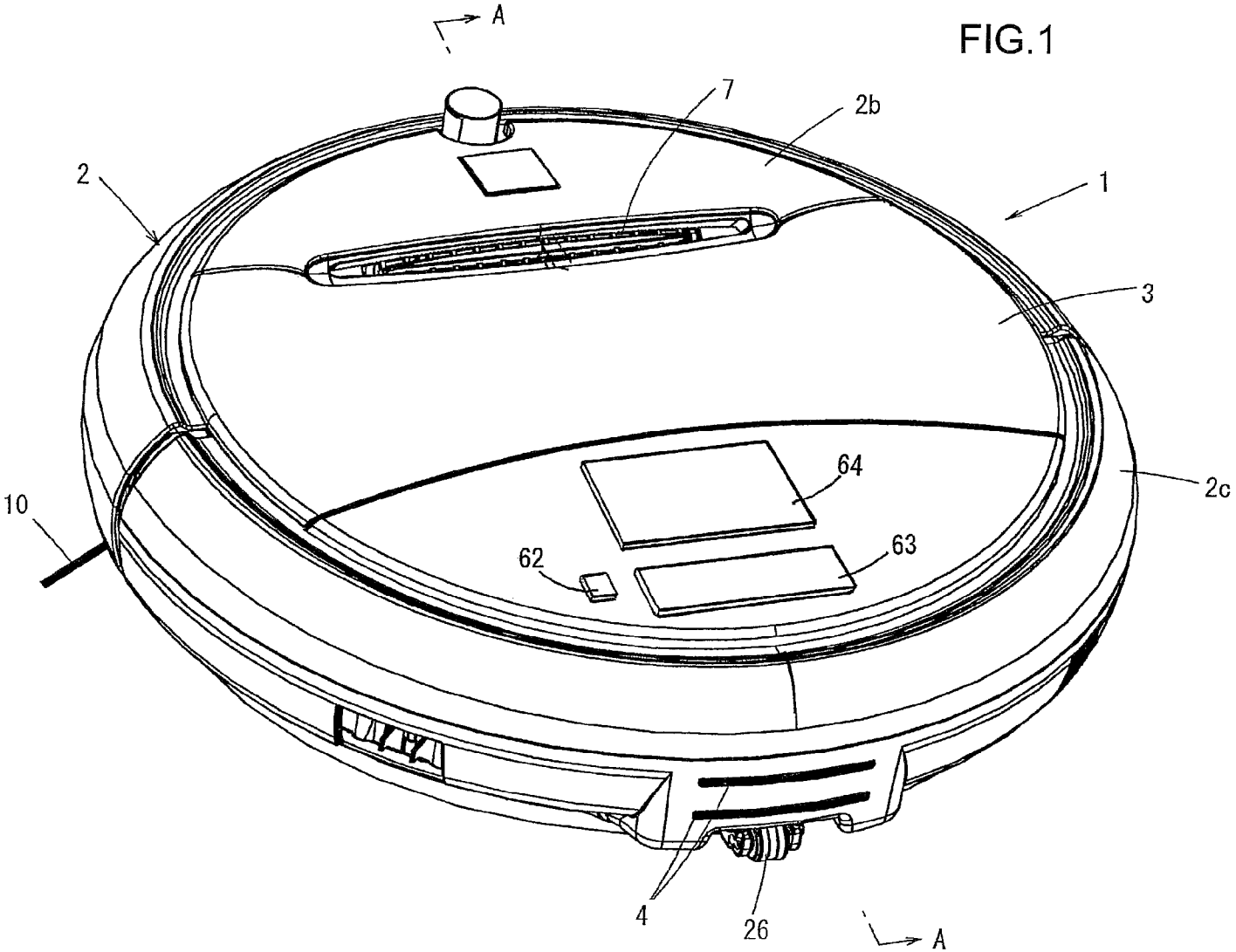
FIG. 1 is a perspective view illustrating an autonomous vacuum cleaner viewed from its top surface according to one embodiment of the present invention.
Figure 2:
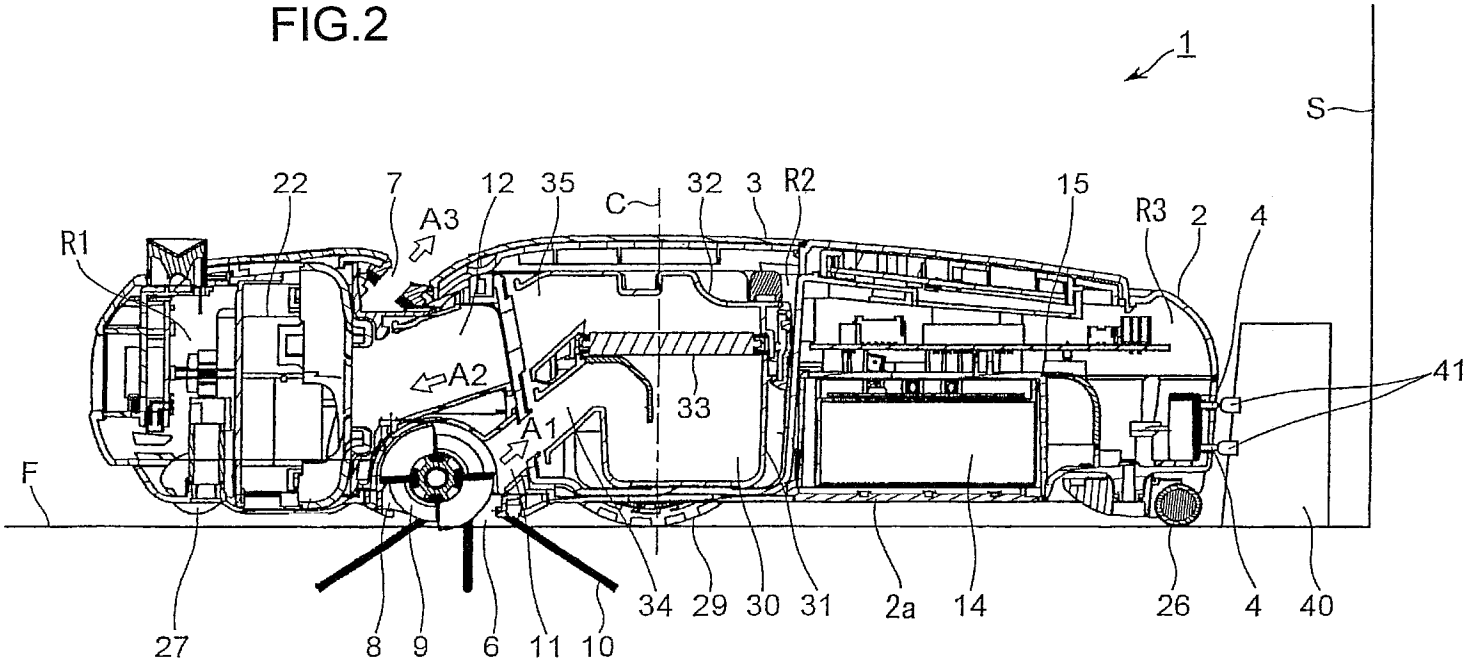
FIG. 2 is a sectional view taken along a line A-A in FIG. 1.
Figure 3:
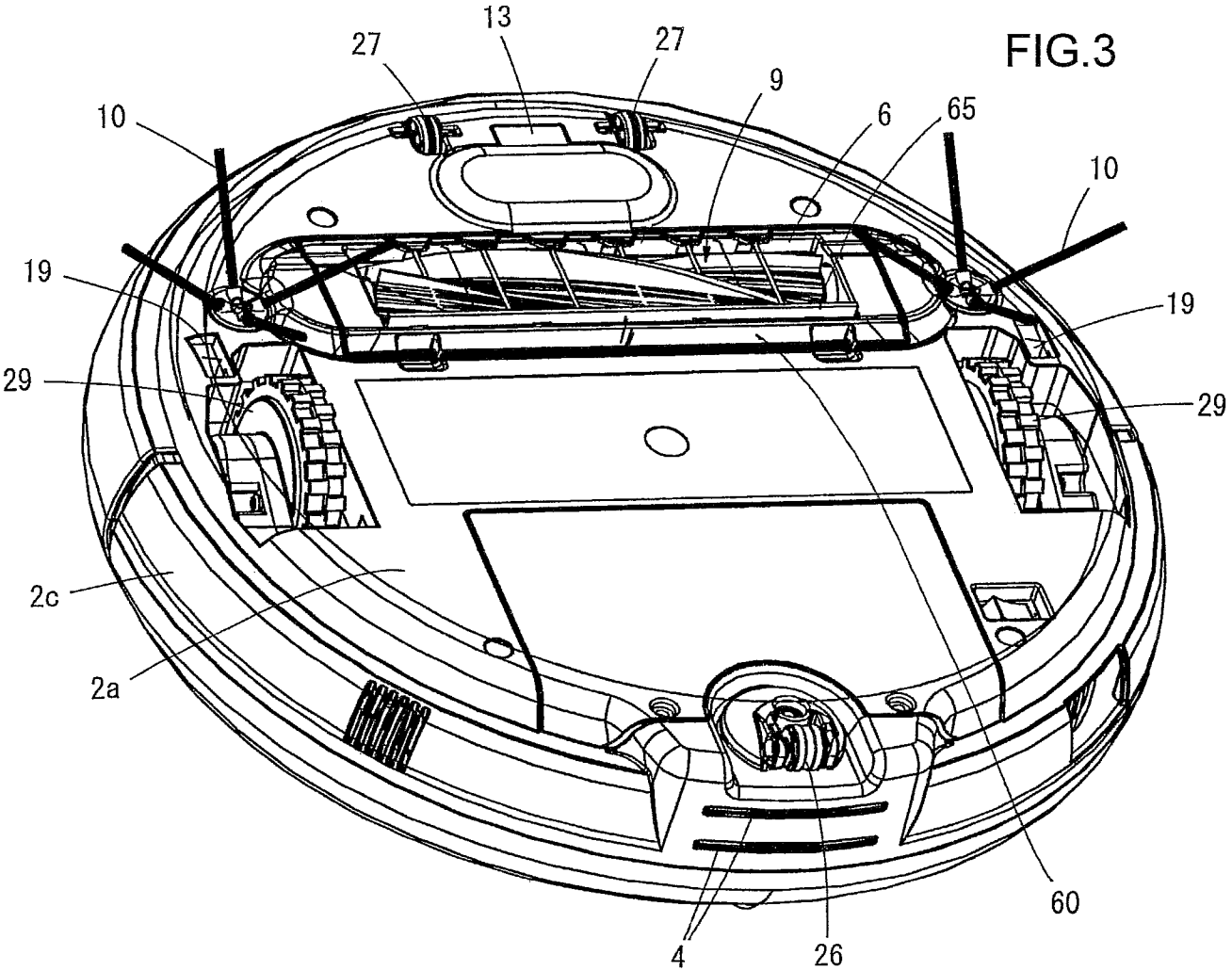
FIG. 3 is a perspective view illustrating the autonomous vacuum cleaner in FIG. 1 viewed from its bottom surface.
Figure 4:
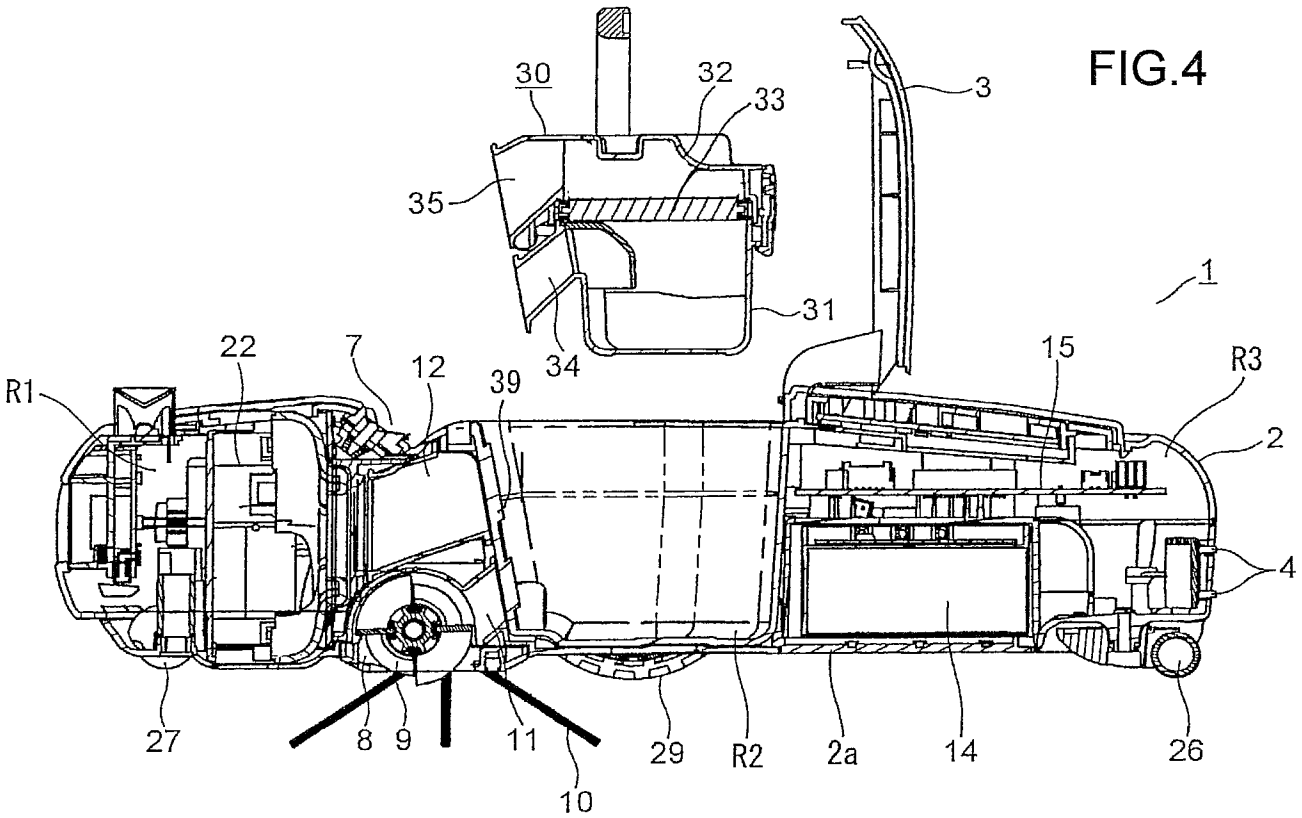
FIG. 4 is a view corresponding to FIG. 2, and illustrating a state in which a dust collection device is removed.
Figure 5:
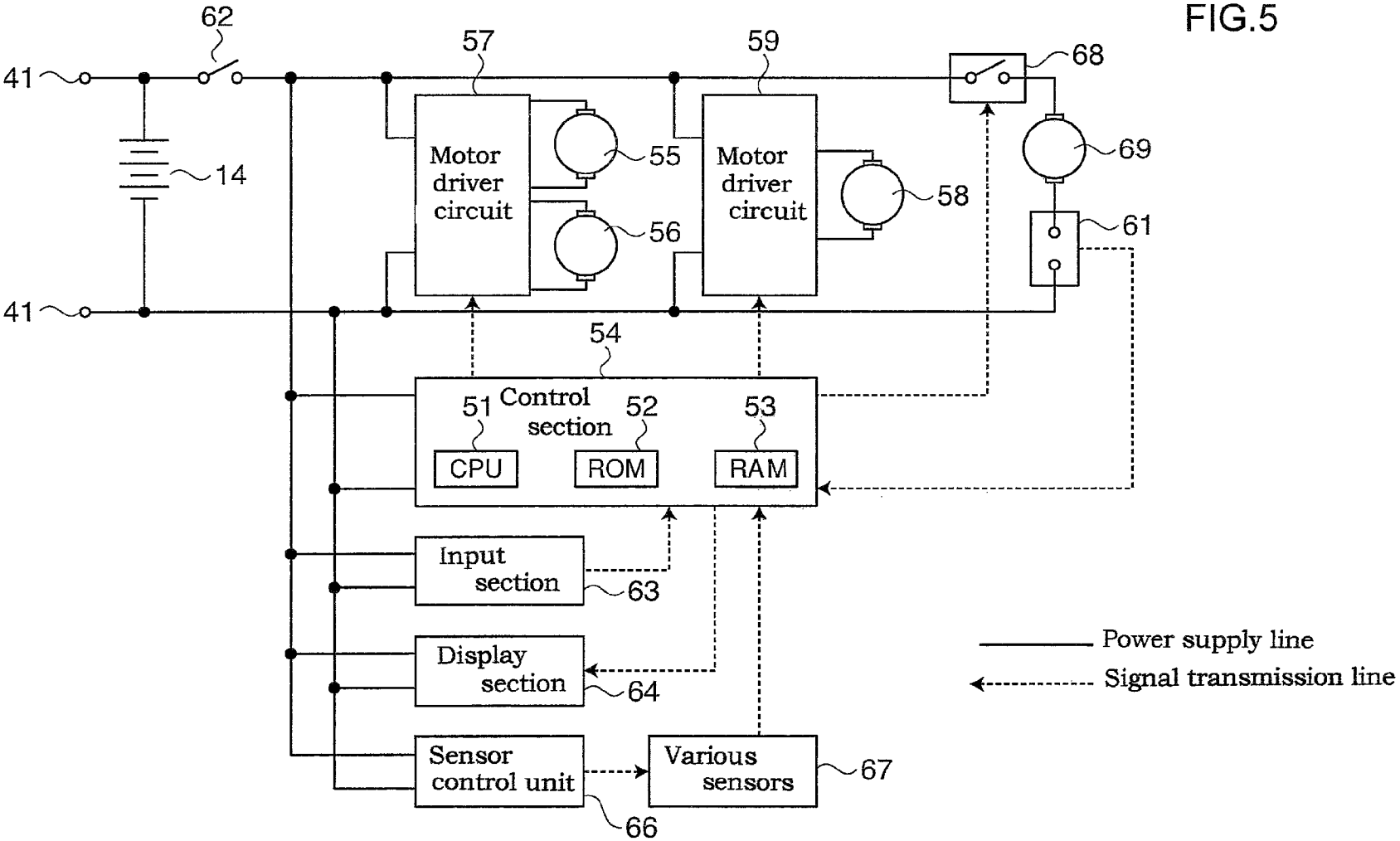
FIG. 5 is a block diagram illustrating a control system in the autonomous vacuum cleaner illustrated in FIG. 1.

FIG. 1 is a perspective view of an autonomous vacuum cleaner, viewed from its top surface, according to an embodiment of the present invention, FIG. 2 is a sectional view taken along a line A-A in FIG. 1, FIG. 3 is a perspective view illustrating the autonomous vacuum cleaner, viewed from its bottom surface, illustrated in FIG. 1, FIG. 4 is a view corresponding to FIG. 2, and illustrating a state in which a dust collection device is removed, and FIG. 5 is a block diagram illustrating a control system in the autonomous vacuum cleaner illustrated in FIG. 1.

As illustrated in FIGS. 1 to 3, an autonomous vacuum cleaner 1 according to the embodiment of the present invention suctions air containing dust on a floor surface (a surface to be cleaned) F (FIG. 2) and exhausts air from which dust is removed, while autonomously moving on the floor surface F of the place where it is placed. Thus, the autonomous vacuum cleaner 1 cleans the floor surface.

The autonomous vacuum cleaner 1 includes a disk-like housing 2, and includes components, such as a rotary brush 9, a side brush 10, a dust collection device (dust collection section) 30, an electric ventilator 22, a pair of drive wheels 29, a rear wheel 26, a front wheel 27, various sensors, and a control section, at the inside and outside of the housing 2.

In the autonomous vacuum cleaner 1, a part where the front wheel 27 is arranged is a front part, a part where the rear wheel 26 is arranged is a rear part, and a part where the dust collection device 30 is arranged is a middle part.

The housing 2 has a base plate 2*a* that is circular in a plan view and that includes a suction port 6 formed at a position of the front part near a boundary with the middle part, a top plate 2*b* including on the middle part a lid section 3 that is opened or closed for loading or unloading the dust collection device 3 to or from the housing 2, and a side plate 2*c* formed along outer peripheries of the base plate 2*a* and the top plate 2*b*.

Plural holes from which the lower parts of the front wheel 27, the pair of drive wheels 29, and the rear wheel 26 project to the outside are formed on the base plate 2*a*, and an exhaust port 7 is formed at the boundary between the front part and the middle part on the top plate 2*b*. The side plate 2*c* is split into two in the front-back direction, wherein the front portion of the side plate is displaceable so as to function as a bumper.

As illustrated in FIG. 1, the autonomous vacuum cleaner 1 includes a power switch (depression switch) 62, an input section (input panel) 63 having a start switch to be operated by a user, a later-described switch for checking whether a dust collection amount is full or not, and switches for inputting various conditions, and a display section (display panel) 64 that displays a warning indicating that the dust collection amount is full or a status of the cleaner, on the rear part of the top plate 2*b* of the housing 2.

As illustrated in FIG. 4, the housing 2 includes inside a front storage chamber R1 into which the electric ventilator 22 is stored at the front part, and an intermediate storage chamber R2 for storing the dust collection device 30 at the middle part. The housing 2 also includes a rear storage chamber R3 for storing a control board 15, a battery 14 (storage battery), a charging terminal 14, and other members in the control section at the rear part. The housing 2 also includes a suction path 11 and an exhaust path 12 in the vicinity of the boundary between the front part and the middle part.

The suction path 11 communicates the suction port 6 and the intermediate storage chamber R2 with each other, and the exhaust path 12 communicates the intermediate storage chamber R2 and the front storage chamber R1 with each other. The respective storage chambers R1, R2, and R3, the suction path 11, and the exhaust path 12 are partitioned by a partition wall 39 that is mounted in the housing 2 for forming spaces for these components.

The pair of drive wheels 29 is fixed to a pair of rotation shafts perpendicularly crossing a centerline C (FIG. 2) passing through the center of the housing 2. When the pair of drive wheels 29 rotates in the same direction, the housing 2 moves forward or backward, and when each drive wheel 29 rotates in the opposite direction, the housing 2 turns around the centerline C of the housing 2.

The rotation shafts of the pair of drive wheels 29 are coupled to independently receive rotation force from each of a pair of drive-wheel motors. Each motor is fixed to the base plate 2*a* of the housing directly or via a suspension mechanism.

The front wheel 27 includes a roller. The front wheel 27 is rotatably provided to a part of the base plate 2*a* of the housing 2 so as to be slightly floated from the floor surface F (FIG. 2) with which the drive wheels 29 are in contact. With this structure, the front wheel 27 contacts a step appearing in the moving route, and the housing 2 can easily go over the step.

The rear wheel 26 is a caster wheel, and it is rotatably provided to a part of the base plate 2*a* of the housing 2 so as to be in contact with the floor surface F with which the drive wheel 29 is in contact.

As described above, the pair of drive wheels 29 is arranged at the middle of the housing 2 in the front-back direction, and the front wheel 27 is floated from the floor surface F. Thus, the weight is distributed with respect to the housing 2 in order that the weight of the autonomous vacuum cleaner 1 can be supported by the pair of drive wheels 29 and the rear wheel 26. With this configuration, dust at the front in the moving route can be guided to the suction port 6 without being hindered by the front wheel 27.

The suction port 6 is an opening surface of a concave portion 8 formed on the bottom surface (base plate 2*a*) of the housing 2 so as to face the floor surface F. A bottom plate 60 (see FIG. 3) serving as a suction member is fitted into the concave portion 8, whereby the suction port 6 is formed. The rotary brush 9 that rotates around a shaft parallel to the bottom surface of the housing 2 is mounted in the concave portion 8, and the side brush 10 that rotates around a rotation shaft vertical to the base plate 2*a* is mounted at both of right and left sides of the concave portion 8.

The rotary brush 9 is formed by helically implanting brushes on the outer peripheral surface of the roller that is the rotation shaft. The side brush 10 is formed by radially providing a brush bundle at a lower end of the rotation shaft. The rotation shaft of the rotary brush 9 and the rotation shaft of the pair of side brushes 10 are respectively supported to a part of the base plate 2*a* of the housing 2 so as to be rotatable. The rotation shaft of the rotary brush 9 is coupled to a brush drive motor that are not illustrated and mounted in the vicinity of the rotation shaft, while the rotation shaft of the side brushes 10 is coupled to the brush drive motor via a power transmission mechanism including a pulley, a belt, and the like.

As illustrated in FIG. 3, a bristle brush 65 serving as a blade-like capturing member for capturing dust, which is not sucked through the suction port 6, to prevent the scattering of dust is provided at the rear end of the suction port 6.

As illustrated in FIG. 3, a floor detection sensor 13 for detecting the floor surface is arranged between the bottom surface of the housing 2 and the front wheel 27, and similar floor detection sensors 19 are arranged at the side in front of the left and right drive wheels 29. When the floor detection sensor 13 detects descending stairs, its detection signal is transmitted to the control section, and the control section controls to stop both drive wheels 29. When the floor detection sensor 13 is in failure, the floor detection sensors 19 can detect the descending stairs, and both drive wheels 29 can be stopped. This configuration can prevent the autonomous vacuum cleaner 1 from falling down the descending stairs.

When the floor detection sensor 19 detects the descending stairs, its detection signal may be transmitted to the control section, and the control section may control the cleaner to avoid the descending stairs.

The control board 15 includes a microcomputer that controls the autonomous vacuum cleaner 1, and a control circuit, such as a motor driver circuit, for driving the respective components such as the drive wheels 29, the rotary brush 9, the side brushes 10, and the electric ventilator 22.

The charging terminal 4 for charging the battery 14 is provided at the rear end of the side plate 2*c* of the housing 2. The autonomous vacuum cleaner 1 that cleans a room while autonomously moving in the room returns to a charging stand 40 (FIG. 2) provided in the room. Thus, the charging terminal 4 is in contact with a terminal section 41 provided to the charging stand 40, whereby the battery 14 is charged. The charging stand 40 connected to a commercial power source (outlet) is generally provided along a side wall S in the room.

The dust collection device 30 is generally stored in the intermediate storage room R2 above the shaft centers of the rotation shafts of both drive wheels 29 in the housing 2. In order to discard the dust collected in the dust collection device 30, the lid section 3 of the housing 2 is opened to load or unload the dust collection device 30 as illustrated in FIG. 4.

The dust collection device 30 includes a dust collection container 31 having an opening, a filter section 33 covering the opening of the dust collection container 31, and a cover section 32 covering the filter section 33 and the opening of the dust collection container 31. The cover section 32 and the filter section 33 are pivotally supported at a front edge of the opening of the dust collection container 31.

An inflow path 34 and an outlet path 35 are provided at the front part of the side wall of the dust collection container 31. The inflow path 34 communicates with the suction path 11 of the housing 2, and the outlet path 35 communicates with the exhaust path 12 of the housing 2 in the state in which the dust collection device 30 is stored in the intermediate storage chamber R2 of the housing 2.

As illustrated in FIG. 5, the control system that entirely controls to drive the autonomous vacuum cleaner 1 includes a control section 54 having a microcomputer composed of a CPU 51, a ROM 52, and a RAM 53; a motor driver circuit 57 that controls the drive-wheel motors 55 and 56 for driving each of two drive wheels 29; a motor driver circuit 59 that controls a brush drive motor 58 for driving the rotary brush 9 and the side brushes 10; a switching element 68 that connects and disconnects a DC motor 69 incorporated into the electric ventilator 22 and the battery 14; a shunt resistor 61 that detects a current flowing through the DC motor 69, i.e., an armature current Ia; the power switch 62; a sensor control unit 66 that controls various sensors 67 including the floor detection sensors 13 and 19; an input section 63; and a display section 64.

A DC motor excited by permanent magnets is used as the DC motor 69.

When the power switch 62 is turned on, the output power from the battery 14 is supplied to the drive-wheel motors 55 and 56 via the motor driver circuit 57, to the brush drive motor 58 via the motor driver circuit 59, and to the DC motor 69 via the switching element 68, and further supplied to the control section 54, the input section 63, the display section 64, and the sensor control unit 66.

The CPU 51 in the control section 54 is a central processing unit. The CPU 51 computes the signals received from the input section 63, the shunt resistor 61, and various sensors 65 based on a program stored beforehand in the ROM 52, and outputs the resultant signals to the motor driver circuits 57 and 59, the switching element 68, and the display section 64.

The RAM 53 temporarily stores various instructions inputted by a user from the input section 63, various operating conditions of the autonomous vacuum cleaner 1, and outputs from the various sensors 65 and the shunt resistor 61.

The RAM 53 can also store a moving map of the autonomous vacuum cleaner 1. The moving map is information relating to the movement of the autonomous vacuum cleaner 1, such as a moving route or a moving speed. The user causes the RAM 53 to preliminarily store the moving map, or the autonomous vacuum cleaner 1 can automatically record the moving map during a cleaning operation. The various sensors 65 include an odor sensor, a humidity sensor, a human sensor, and a contact sensor, as well as the floor detection sensors 13 and 19.

The odor sensor detects an odor around the outside of the housing 2. A semiconductor odor sensor or a contact combustion type odor sensor can be used as the odor sensor, for example. The odor sensor is arranged to be exposed to the outside from the side plate 2*c* or the top plate 2*b* of the housing 2 in order to detect the odor around the outside of the autonomous vacuum cleaner 1. The control section 54 acquires odor information around the outside of the housing 2 based on the output signal from the odor sensor.

The humidity sensor detects humidity around the outside of the housing 2. An electrostatic capacitance humidity sensor or an electric resistance humidity sensor using a polymer humidity sensitive material can be used as the humidity sensor, for example. The humidity sensor is arranged to be exposed to the outside from the side plate 2*c* or the top plate 2*b* of the housing 2 in order to detect a relative humidity around the outside of the autonomous vacuum cleaner 1, for example. The control section 54 acquires humidity information around the outside of the housing 2 based on the output signal from the humidity sensor.

A human sensor that detects a presence of a human by infrared ray, ultrasonic wave, or visible light can be used as the human sensor, for example. The human sensor is arranged to be exposed to the outside from the side plate 2*c* or the top plate 2*b* of the housing 2 in order to detect a presence of a human around the outside of the autonomous vacuum cleaner 1, for example. The control section 54 acquires information about a presence of a human around the outside of the housing 2 based on the output signal from the human sensor.

The contact sensor is arranged at the front of the side plate 2*c* of the housing 2, for example, in order to detect that the autonomous vacuum cleaner 1 contacts an obstacle when moving. The control section 54 acquires information about a presence of an obstacle around the outside of the housing 2 based on the output signal from the contact sensor.

In the autonomous vacuum cleaner 1 thus configured, the electric ventilator 22, the drive wheels 29, the rotary brush 9, and the side brushes 10 are driven according to an instruction for the cleaning operation. Thus, the housing 2 autonomously moves within a predetermined range with the state in which the rotary brush 9, the side brushes 10, the drive wheels 29, and the rear wheel 26 are in contact with the floor surface F, and sucks air containing dust on the floor surface F from the suction port 6. In this case, dust on the floor surface F is scraped by the rotation of the rotary brush 9, and guided to the suction port 6. Dust at the side of the suction port 6 is also guided to the suction port 6 by the rotation of the side brushes 10.

Air sucked into the housing 2 from the suction port 6 and containing dust passes through the suction path 11 of the housing 2 and the inflow path 34 of the dust collection device 30, and flows into the dust collection container 31 as indicated by an arrow A1 in FIG. 2. The stream of air flown into the dust collection container 31 passes through the filter section 33, flows into a space between the filter section 33 and the cover section 32, and is exhausted to the exhaust path 12 of the housing 2 through the outlet path 35. In this case, the dust contained in the stream of air in the dust collection container 31 is captured by the filter section 33, so that dust is accumulated in the dust collection container 31.

The stream of air flown into the exhaust path 12 of the housing 2 from the dust collection device 30 flows into the front storage chamber R1 to circulate into a first exhaust path and a second exhaust path, which are not illustrated, as indicated by an arrow A2 in FIG. 2. Clean air from which dust is removed by the filter section 33 is discharged to an obliquely upper portion at the rear part from the exhaust port 7 formed on the top surface of the housing 2 as indicated by an arrow A3 in FIG. 2. Thus, the floor surface F is cleaned. In this case, air is exhausted toward the obliquely upper portion at the rear part from the exhaust port 7, whereby this structure prevents dust on the floor surface F from being blown up, and can enhance a cleaning level in the room.

The autonomous vacuum cleaner 1 moves forward by the forward rotation of the left and right drive wheels 29 in the same direction, and moves backward by the backward rotation in the same direction. The autonomous vacuum cleaner 1 turns around the centerline C, when each of the left and right drive wheels 29 rotates in the opposite direction. For example, when the autonomous vacuum cleaner 1 reaches the periphery of the cleaning region, and when the autonomous vacuum cleaner 1 collides against an obstacle in its moving route, the drive wheels 29 stop, and then, each of the drive wheels 29 rotates in the opposite direction to change the direction of the autonomous vacuum cleaner 1. Thus, the autonomous vacuum cleaner 1 can autonomously move in the entire place where the cleaner 1 is placed or in the entire desired range, while avoiding an obstacle.

The autonomous vacuum cleaner 1 contacts the floor surface on three points that are the left and right drive wheels 29 and the rear wheel 26, and the weight of the autonomous vacuum cleaner 1 is distributed with a balance by which the rear wheel 26 is not floated from the floor surface F, even if the autonomous vacuum cleaner 1 suddenly comes to a stop when moving forward. This configuration prevents the situation in which the autonomous vacuum cleaner 1 suddenly comes to a stop in front of descending stairs when moving forward, falls forward by the sudden stop, and falls down the descending stairs. Each of the drive wheels 29 is formed such that a rubber tire having a groove is fitted to a wheel in order to prevent a slippage by a sudden stop.

Since the dust collection device 30 is arranged above the rotation shafts of the drive wheels 29, the weight balance of the autonomous vacuum cleaner 1 is maintained, even if the weight is increased due to collected dust.

After finishing the cleaning operation, the autonomous vacuum cleaner 1 returns to the charging stand 40 (FIG. 2). Thus, the charging terminal 4 is in contact with the terminal section 41, whereby the battery 14 is charged.

2. Dust Collection Amount Detecting Unit

A dust collection amount detecting unit, particularly a full dust collection amount detecting unit, which is one of the features of the present invention, will be described below.

Figure 6:
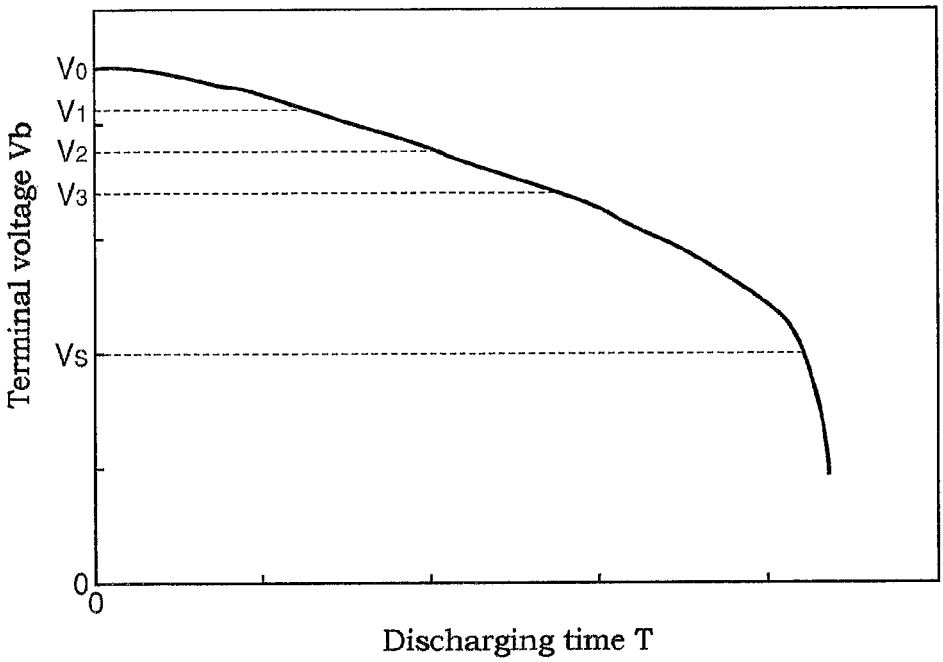
FIG. 6 is a discharge characteristic diagram of a battery (storage device) in the autonomous vacuum cleaner illustrated in FIG. 1.

FIG. 6 illustrates a change in a terminal voltage Vb with respect to a discharging time T when the battery (storage battery) 14 is discharged with a constant current. It is understood from FIG. 6 that the terminal voltage Vb gradually decreases as $V_0$, $V_1$, $V_2$, and $V_3$, and finally decreases to a discharge stop voltage (rechargeable voltage) Vs with the lapse of the discharging time T, i.e., with the reduction in the remaining battery life. A lithium ion battery, a nickel-hydrogen battery, or a Ni—Cd battery is used for the battery 14.

Figure 7:
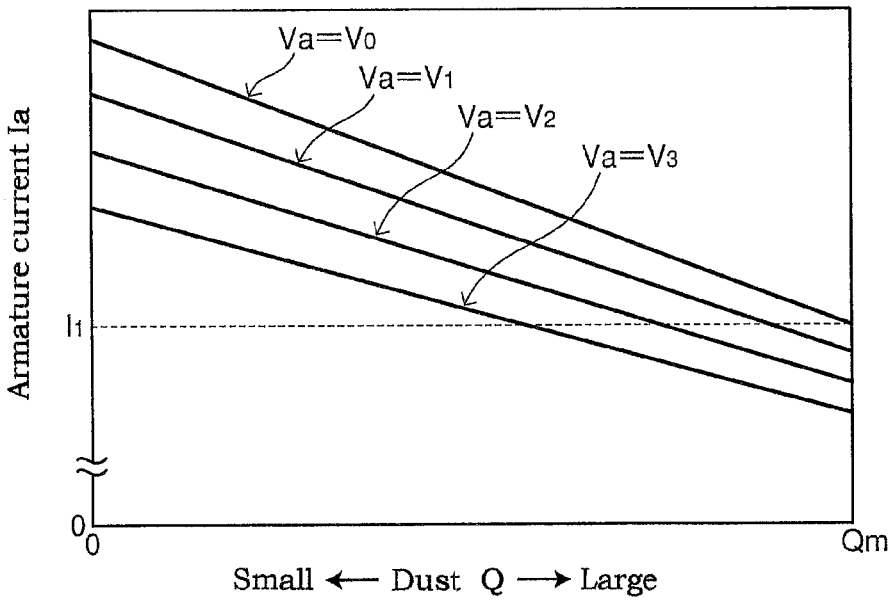
FIG. 7 is a characteristic diagram illustrating a relationship between a dust collection amount and an armature current of the autonomous vacuum cleaner illustrated in FIG. 1, wherein an armature voltage is used as a parameter.

FIG. 7 illustrates a change in an armature current Ia of the DC motor 69 with respect to the dust collection amount Q of the dust collection device (dust collection section) 30 when the armature voltage Va of the DC motor 69 decreases to $V_0$, $V_1$, $V_2$, and $V_3$.

It is understood from FIG. 6 that:

(1) the armature current Ia decreases, as the dust collection amount Q increases toward the maximum value Qm (full), (2) the armature current Ia with respect to the same dust collection amount Q decreases, as the armature voltage Va decreases, and (3) in the case of $Va=V_0$, the dust collection amount Q becomes Qm (Q=Qm) (full), when an equation $Ia=I_1$ is established. However, the dust collection amount Q in the case of $Ia=I_1$ gradually becomes smaller than Qm, as Va decreases to $V_1$, $V_2$, and $V_3$.

In view of this, in the present invention, conditions of $Ia \leq I_1$ and $Va \geq V_1$ are preliminarily set as Ia and Va by which Q can be regarded as almost Qm.

Since the battery 14 and the DC motor 69 are directly connected through the switching element 68 as illustrated in FIG. 5, the terminal voltage Vb of the battery 14 is equal to the armature voltage Va of the DC motor 69 (Vb=Va). Therefore, when the conditions of $Ia \leq I_1$ and $Va \geq V_1$ are satisfied, the dust collection amount is determined to be full.

Figure 8:
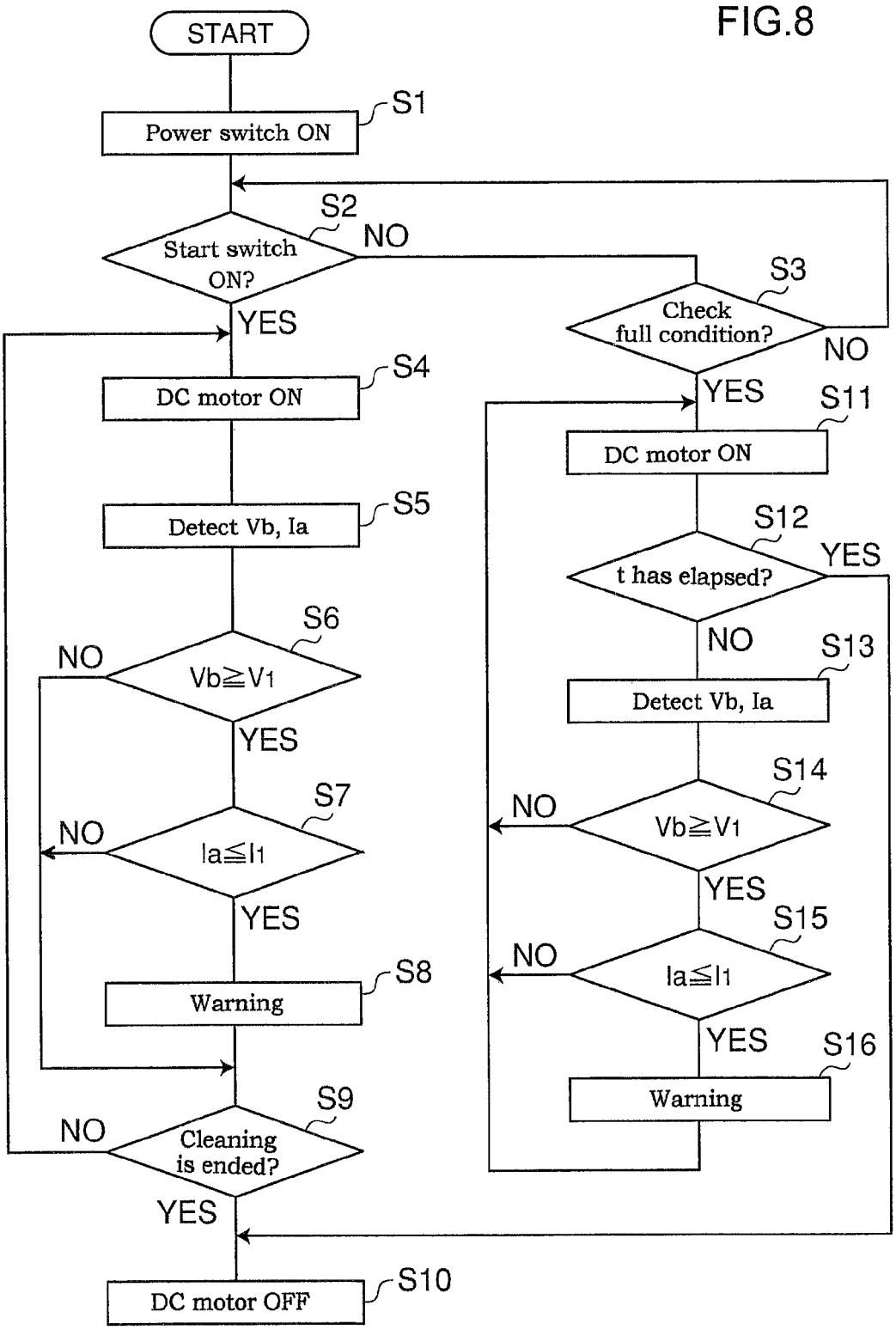
FIG. 8 is a flowchart illustrating an operation of an essential part of the autonomous vacuum cleaner illustrated in FIG. 1.

The operation of detecting whether the dust collection amount is full or not using the conditions described above will be described with reference to a flowchart in FIG. 8.

In step S1, when the power switch 62 is turned on, it is confirmed whether the start switch of the input section 63 is turned on or not (step S2). When the start switch is turned on, the switching element 68 is turned on, so that the DC motor 69 is driven to start the electric ventilator 22. Thereby, the cleaning operation is started (step S4), and the terminal voltage Vb of the battery 14 and the armature current Ia of the DC motor 69 are detected (step S5).

In the case of $Vb \geq V_1$ and $Ia \leq I_1$ (steps S6 and S7), it is determined that the dust collection amount in the dust collection device (dust collection section) 30 is full, and the warning is displayed on the display section 64 (step S8). Even after that, the DC motor 69 is continuously driven, and when "completion of cleaning" is instructed from the input section 63 or from the program in the ROM 52, the DC motor 69, i.e., the electric ventilation 22 stops (steps S9 and S10).

In step S2, when the start switch of the input section 63 is not turned on, i.e., the start of the cleaning operation is not instructed, and the start of "checking full condition" is manually inputted by the input section 63 or automatically instructed by the program in the ROM 52 after the charging of the battery 14 is completed (step S3), the DC motor 69 is driven (step S11).

When a time t (e.g., 60 seconds) has not elapsed after the DC motor 69 is driven (step S12), Vb and Ia are detected (step S13).

In the case of $Vb \geq V_1$ and $Ia \leq I_1$ (steps S14 and S15), it is determined that the dust collection amount is full, and the warning is displayed on the display section 64 (step S16). When the time t has elapsed after that, the DC motor 69 (electric ventilator 22) stops (step S10), whereby the operation of "checking full condition" is completed.

As described above, not only whether the dust collection amount is full or not can be detected during the cleaning operation, but when the cleaning operation is not performed, whether the dust collection amount is full or not can easily be checked.

As described above, the DC motor is used for the electric ventilator as one example. However, it is obvious that the present invention can similarly be embodied by using an AC motor or a rotation motor for the electric ventilator.

The present embodiment describes an autonomous vacuum cleaner. However, it is obvious that the present invention can similarly be embodied in a charging-type electric vacuum cleaner described in Patent Document 1.

DESCRIPTION OF REFERENCE SIGNS

1: Autonomous vacuum cleaner
2: Housing
2*a*: Base plate
2*b*: Top plate
2*c*: Side plate
3: Lid section
4: Charging terminal
6: Suction port
7: Exhaust port
8: Concave portion
9: Rotary brush
10: Side brush
11: Suction path
12: Exhaust path
13: Floor detection sensor
14: Battery (storage battery)
15: Control board
19: Floor detection sensor
22: Electric ventilator
26: Rear wheel
27: Front wheel
29: Drive wheel
30: Dust collection device (dust collection section)
31: Dust collection container
32: Cover section
33: Filter section
34: Inflow path
35: Outlet path
39: Partition wall
40: Charging stand
41: Terminal section
51: CPU
52: ROM
53: RAM
54: Control section
55: Drive-wheel motor
56: Drive-wheel motor
57: Motor driver circuit
58: Brush drive motor
59: Motor driver circuit
60: Bottom plate
61: Shunt resistor
62: Power switch
63: Input section (input panel)
64: Display section (display panel)
65: Bristle brush
66: Sensor control unit
67: Various sensors
68: Switching element
69: DC motor
R1: Front storage chamber
R2: Intermediate storage chamber
C: Centerline
F: Floor surface
S: Side wall
R3: Rear storage chamber

The invention claimed is:

1. A charging-type electric vacuum cleaner comprising:
a ventilator for suctioning air containing dust through a suction port;
a motor for driving the ventilator;
a dust collection section for filtering the suctioned air and capturing the dust;
a storage battery;
a switching element for connecting the storage battery to the motor;
a current detecting section for detecting an electric current Ia flowing to the motor;
a warning section for warning when a dust collection amount in a dust collection section is full; and
a control section for operating the switching element to drive the motor, and for detecting a terminal voltage Vb of the storage battery and the electric current Ia to operate the warning section when $Vb \geq V_1$ and $Ia \leq I_1$ ($V_1$ and $I_1$ are preset values) are established.

2. The charging-type electric vacuum cleaner according to claim 1, wherein
the control section continues to drive the motor even after the warning section is operated.

3. The charging-type electric vacuum cleaner according to claim 1, further comprising:
a manual input section for instructing a checking operation of a dust collection amount to the control section, wherein
the control section drives the motor for a predetermined time in response to an output from the manual input section.

4. The charging-type electric vacuum cleaner according to claim 1, wherein
the control section does not operate the warning section even if the current Ia flowing to the motor satisfies $Ia < I_1$, when the terminal voltage Vb of the storage battery satisfies $Vb < V_1$.

* * * * *